United States Patent [19]

Davidson

[11] Patent Number: 4,776,808

[45] Date of Patent: Oct. 11, 1988

[54] GROUND CONTACTOR

[76] Inventor: Richard J. Davidson, 2 Hooper Ave., West Orange, N.J. 07052

[21] Appl. No.: 25,878

[22] Filed: Mar. 16, 1987

[51] Int. Cl.[4] ..... H01R 4/26

[52] U.S. Cl. ..... 439/100; 439/431; 439/435; 439/804; 439/814

[58] Field of Search ..... 439/92, 100, 431–435, 439/785, 804, 810–814

[56] References Cited

U.S. PATENT DOCUMENTS

| | | | |
|---|---|---|---|
| 1,675,163 | 6/1928 | Colburn | 339/14 |
| 1,986,028 | 1/1935 | Terry | 339/14 |
| 2,396,119 | 3/1946 | O'Neil | 133/340 |
| 2,423,714 | 7/1947 | Leonard | 204/297 |
| 2,551,636 | 5/1951 | Ratigan | 339/265 |
| 2,701,351 | 2/1955 | Weber | 339/265 |
| 2,777,096 | 1/1957 | Weisberg | 317/69 |
| 2,865,013 | 12/1958 | Kazanowski | 339/272 |
| 3,046,511 | 7/1962 | Rinehuls et al. | 339/13 |
| 3,094,366 | 6/1963 | Harmon, Jr. | 339/97 |
| 3,129,994 | 4/1964 | Harmon et al. | 339/95 |
| 3,609,631 | 9/1971 | Looney et al. | 439/100 |
| 3,901,577 | 8/1975 | Philibert et al. | 439/804 |

*Primary Examiner*—J. Patrick McQuade

*Attorney, Agent, or Firm*—Weingram and Zall

[57] ABSTRACT

A ground contactor couples to the space between the pipe fitting used in the electrical supply conduit. The contactor consists of a knife-edge contacting surface having a screw thread adjustment located at the surface. The screw thread is a pointed screw thread which is adjustable without removing the contact surface for the space. The contact surface is clamped by a U-shaped clamp and tightened securely in the pipe fitting space. Angular contact surfaces are provided at the points of threaded adjustment between the clamp and the contactor so that forces are created for adjusting the clamp relative to the contact surfaces to permit the device to be used on conduits of different diameters. The contactor thus shaped and configured permits permanent electrical ground contact to be achieved and also permits serviceability of the electrical conductivity of the conduit connection arrangement without the necessity to move or otherwise disturb the ground contactor installation.

4 Claims, 3 Drawing Sheets

GROUND CONTACTOR

BACKGROUND OF THE INVENTION

1. Field of the Invention

This invention relates to an improved electrical ground contacting device to be used to establish a permanent yet serviceable electrical grounding connection for one or two grounding contactors to existing electrical service meter box cable connectors or conduit connectors, or thick-walled or rigid piping and conduit.

2. Description of the Prior Art

The prior art discloses a variety of devices to provide the ability to make a ground connection to existing electrical conduit, cables, ground rods or water and gas piping.

U.S. Pat. No. 2,396,119 O'Neil shows a clamp device surrounding a live insulated electrical wire. Elements of the clamp are tightened to such an extent that a pointed protrusion breaks through the cable insulation and makes contact with the conductive interior thereof. This conductive point is coupled to connecting wires in the clamping arrangement which serve to connect the contact in the wire to the desired location.

U.S. Pat. No. 1,675,163 to Colburn discloses a grounding clamp arrangement where the ground clamp is attached to a pipe or other object and is designed to maintain proper contact despite rust, dirt or other matter which may accumulate on the pipe. The clamp has an attaching screw which directly contacts the pipe. The screw is pointed and hardened so that it will cut through the rust or scale on the pipe and bite into the metal of the pipe and thus provides for direct electrical connection to the pipe via the screw.

U.S. Pat. No. 1,986,028 to Terry shows a clamping arrangement for securing an electrical conduit to a ground pipe. The device clamps the conduit and the pipe to each other via a conductive spacer which, by virtue of the clamps, is held in electrical contact between the two elements.

U.S. Pat. No. 2,701,351 to Weber shows a ground clamp for a water pipe. The pipe is clamped to the U-bolt. The bolt clamps the curved plate which is provided with a set of teeth. The teeth are designed to provide a more positive form of gripping surface for engaging cylindrical peripheries of pipes of different diameters.

Other patents which represent other devices for maintaining good ground connection are U.S. Pat. Nos. 2,777,096; 2,865,013; 3,094,366; 3,046,511 and 3,129,994.

OBJECTS AND SUMMARY OF THE INVENTION

The present invention utilizes the bar and U-bolt concepts which are described in several of the prior art patents discussed above. However, in Applicant's invention, the U-bolt clamps a specially designed yoke which is formed in an arc distance such that the yoke can maintain contact with the periphery of the conduit pipe. The contacting surface of the yoke is in the form of a knife-edge surface. Centrally located in the knife-edge surface is a screw-thread aperture which contains a hardened sharp pointed screw therein. The knife-edge aperture is thus suitable for interfitting on pipes or conduits between the spaces and interstices developed in the pipe-fittings or cable connectors therein.

Thus, for example, where a small space exists when a section of pipe connects to a fitting in a screw-threaded fitting arrangement, the knife-edge surface of the present invention is designed to interfit within that space. This ability to interfit within the space solves many of the problems associated with devices of the prior art. The mechanical force required to maintain connection between the knife-edge and the cable connector spaces is provided by the U-bolt and the compression nuts associated therewith.

A hardened set screw centrally located in the contacting knife-edge can be removed and replaced without the need of removing the contactor or degrading the contactor's electrical conductivity. Thus, the set screw can be manipulated to maintain optimum electrical conductivity between the contactor and the surface upon which it is mounted. The set screw performs no mechanical function but is rather solely to provide improved and maintainable electrical conductivity. This is to be contrasted with the use of such conductive screws in the prior art. The prior art teaches that such screws should be used to secure the clamp to the conductive surface upon which it is mounted. Applicant, on the other hand, manipulates the screw such that it exerts forces in opposition to the securing forces of the U-bolt. The effect of this action is to therefore provide for adjustability at the point of contact to maintain and enhance the electrical conductivity between the ground contactor and the surface upon which it is mounted.

The yoke of the present invention contains two holes as recepticals for large diameter grounding conductors up to and including AWG #6 solid wire. Each receptical is fitted with an independent set screw which mechanically and electrically secures the ground wire to the ground contactor. The surface of the yoke directly beneath the washer headed set screws has been recessed to accommodate smaller diameter grounding conductors down to and including AWG #18 solid wire.

The present invention has been specifically designed to accommodate one or two grounding conductors as permitted by the *National Electrical Code,* 1984 Edition (NEC84), Article 250, paragraph 115 (250-115). This is essential to the Community Antenna Television (CATV) industry, since a major percentage of the CATV coaxial cable contains an electrically conductive strength member known as a "messenger". The proper grounding of both the coaxial cable sheath and the messenger demands the utilization of a ground contactor which has the ability to properly secure up to two grounding conductors.

The ground connection provided by the present invention results in improved compliance with the *National Electrical Code,* 1984 Edition (N.E.C.84). The ground contactor, while primarily designed to be used for external electrical grounding connection to existing electrical service meter box cable or conduit connectors, can also be used as authorized by NEC84 Article 250, on thick-walled or rigid piping and conduit.

NEC84 Article 820-7 requires that Community Antenna Television (CATV cable television) "coaxial cable shall be grounded at the building as close to the point of entry as practicable." Commentary included in the *National Electrical Code Handbook* (1984 Edition) (NECH84) Article 820-E, page 999, states that "the code does not say these grounding means must be readily available; if they exist, they are required to be used.". Further commentary provides clarification by stating that "proper bonding of the CATV system coaxial cable sheath to the electrical power ground is needed to prevent potential fire and shock hazards."

NEC84 Article 250-71(a)(2) assures the ground continuity of the existing electrical meter housing and the cable or conduit connectors attached thereto. The electrical service meter housing is typically in the vicinity at the point of coaxial cable entry into the building.

Therefore, CATV coaxial cable grounding to the electrical meter housing conduit or cable connectors would appear ideal. Ownership of these connectors is vested in the building owner. Thus, any permissions required to be obtained in order to attach grounding to these connectors is readily obtainable from the building owner.

NEC84 Article 250-61(a) permits the connection of a ground circuit conductor to the supply side of the electrical disconnecting means. Thus, NEC84 provides the authority for the design and use of the grounding device of the present invention which mechanically and electrically provides suitable grounding connection to an installation such as the electrical service meter housing connectors in accordance with NEC84 Article 250-K.

NEC84 requirements primarily set forth in Articles 250-112, 250-114, and 250-115 are met by the present invention.

NEC84 250-112 requires "permanent and effective grounding". Most ground clamps when mounted on the meter housing electrical service entrance cable connector provide such an effective ground; however, due to physical size and structure of the prior ground clamps, clamp removal may become necessary for the periodic tightening of the electrical service entrance cable connectors' water-tight bushing compression nut. Thus, because of this need to retighten the nut, a permanent ground connection cannot be provided by the clamping apparatus of the prior art.

NEC84 250-114 requires "the arrangement shall be such that the disconnection or the removal of a receptacle, fixture, or other device fed from the box will not interfere with or interrupt the grounding continuity". Proper installation of Applicant's invention on the electrical service entrance cable connector or conduit at the meter housing ensures full compliance with this requirement. The only action necessitating the interruption of the grounding continuity is the actual removal of the electrical service entrance cable connector itself. In order to effect such removal from the meter housing, the electrician will have to first disconnect or have disconnected the electrical service. Since the electrical service is OFF subsequent disconnection of the grounding connection of the present invention poses little or no shock or fire hazard.

NEC84 250-115 requires that "the grounding conductor shall be connected to the ground fitting by suitable lugs, pressure connectors, clamps or other approved means". NEC84 820-22(c) reguires that "the grounding conductor shall not be smaller than no. 18". The present invention will accommodate small grounding conductor wire sizes as well as the larger sizes employed.

The principal object of the present invention is to provide grounding effectiveness with maximum compliance to the requirements of NEC84. Another object of the present invention is to provide an electrical ground contactor which continues to maintain electrical contact despite the periodic maintenance service of the electrical services cable connector's water-tight bushing. A further object of the present invention is to provide a ground contactor which will effectively connect one or two grounding contactors of the same or different sizes.

A still further object of the present invention is to provide for a mechanical configuration of the inside wall of each hole in the contactor through which the shanks of the standard U-bolt pass for the purpose of securing the contactor to the standard connector or conduit to allow for the unrestricted forced mechanical reshaping of U-bolt when a contactor is utilized to a conduit having an outside diameter which is less than a pre-determined size.

Another object of the present invention is to provide an angled surface under the compression nuts of the U-bolt to ensure that forces are applied to the straight shanks of the U-bolt inducing an inward squeezing force to create tighter and more permanent clamping of the U-bolt around the connector or conduit.

A still further object of the present invention is to provide a knife, or V-shaped face, of the contactor to provide improved mechanical and electrical contact to the outside threaded surface of the connector or conduit upon which the contactor is mounted. A still further object of the present invention is to provide for the slopes of the sides and the length of the V-shaped face of the contactor to be such that adequate clearance for a potential periodic maintenance of the water-tight bushing compression nut on the electrical service entrance connector can be performed without removal of the contactor.

A still further object of the present invention is to provide a point-ended hardened set screw mounted in the V- or knife-shaped contacting surface to provide a second means of ensuring an effective and serviceable electrical connection to the connector or conduit. A still further object of the present invention is to provide a ground contactor with electrical conductivity which will not be inhibited by the presence of residual paint, rust or corrosion which may not be entirely removed from the mounting surface of the connector or conduit.

These as well as further objects and advantages of the invention will become apparent to those skilled in the art in review of the detailed specification which follows, reference being made to the accompanying drawings.

BRIEF DESCRIPTION OF THE DRAWINGS

Turning now to FIG. 1, there is shown U-clamp 2 having a standard screw threaded portions at either end thereof for engagements with locking nuts 10 and 12 respectively. The screw threaded portions pass through holes in contactor 4. The shape of the unit configurations of these holes in contactor 4 and the angle of the surface at which nuts 10 and 12 contact the contactor 4 will be explained in further detail in connection with FIG. 2. Washers 22 and 24 can be provided between the nuts 10 and 12 and the contacting surfaces for these nuts on contactor 4. Also affixed to contactor 4 are two connecting screws 14 and 16. Screws 14 and 16 are provided for electrical connection of the grounding conductors to be grounded. Screw 18 is a point-ended hardened screw which enters the contactor 4 through hole 17 and extends through contactor 4 exiting the knife-edge at point 20. Screw 18 provides a serviceable and second means of electrical connection between the contactor 4 and the mounting surface.

Figure 1:
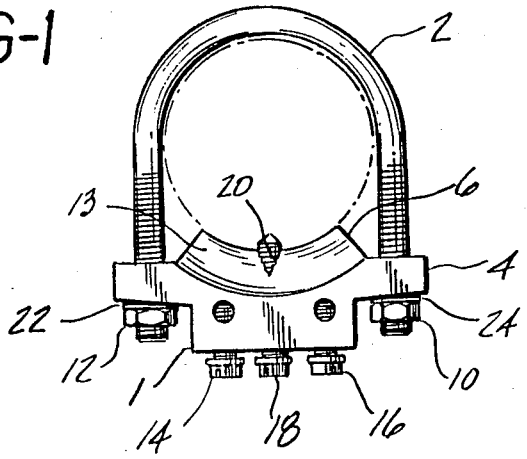
FIG. 1 is a side-view of the assembled contactor of the invention.
Figure 3:
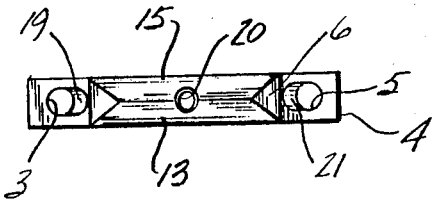
FIG. 3 is a top-view of the contactor assembly of FIG. 2.
Figure 5:
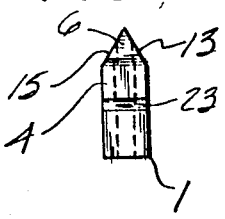
FIG. 5 is a side-view of the contactor assembly of FIG. 2.
Figure 2:
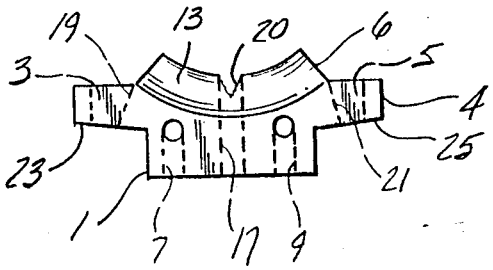
FIG. 2 is a side-view of the contactor portion of the assembly of FIG. 1.
Figure 4:
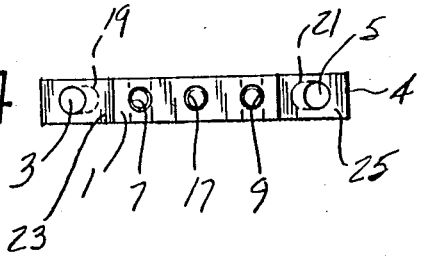
FIG. 4 is a bottom-view of the contactor assembly of FIG. 2.

FIG. 2 shows a side-view of the yoke portion 4 of the contactor of FIG. 1. The yoke 4 has a blade portion 6 formed integrally therewith. As shown in FIG. 5, blade portion 6 consists of two tapered surfaces 13 and 15 each at an angle of 30° with respect to the vertical center line. The tapered surfaces 13 and 15 thus form a knife edge.

Integrally formed in yoke 4 are two holes 3 and 5. Hole 3 is formed with a tapered inner surface 19 and hole 5 is formed with a tapered inner surface 21. These tapered surfaces may be angled at 20° with respect to the vertical.

Further, the surface beneath holes 3 and 5 shown at 23 for hole 3 and 25 for hole 5 is tapered at an angle of say 5° with respect to the horizontal. As will be explained below, the tapered inner walls 19 and 21 and the tapered surfaces 23 and 25 serve to ensure and direct the forces applied via the nuts 10 and 12 and the U-clamp 2 are such that good contact is maintained between the conduit and the ground contactor and forces are generated which tend to deform the U-bolt 2 to conduits of different diameters.

A hole 17 is centrally drilled and tapped through yoke 4. The threaded hole 17 thus forms a V-shaped opening 20 in tapered surface 6. As can be seen from FIG. 2, tapered surface 6 is curved and extends laterally for an angle of 40° with respect to the vertical. The yoke 4 is formed on a flat base portion 1 which base portion contains two holes 7 and 9 drilled therein for receiving screws 14 and 16 respectively. Screw 18 interfits within the threaded hole 17.

The tapered surfaces 19 and 21 on the inner side of the holes in the yoke through which the shanks of the standard U-bolt pass allow for the unrestricted forced mechanical reshaping of the U-bolt when using the contactor on connectors or conduits with an outside diameter of less than a pre-determined maximum which in the preferred embodiment is two inches.

The 5° tapered surfaces 23 and 25 ensure an inward squeezing force being applied to the straight shanks of the U-bolt, thus creating a tighter and more permanent clamping of the U-bolt about the connector or conduit as well as aid the mechanical forced reshaping of the U-bolt when used on connectors or conduits having less than the pre-determined preferred embodiment outside diameter of two inches.

The size and angles of the surfaces 13 and 15 forming tapered surface 6 are designed such as to provide adequate clearance for periodic maintenance of the watertight bushing compression nut on the electrical service entrance cable connector.

As shown in FIG. 1, a standard 90° point-ended set screw 18 is designed for insertion into the threaded hole 17 and exits the tapered surface 6 from a V-shaped aperture 20 formed in tapered surface 6 by threaded hole 17. In the preferred embodiment, the set screw is intended to be driven to its maximum torque after the contactor has been fully installed and mechanically torqued in place at the U-bolt nut torque pressure. Due to the fact that it may be impossible to remove all paint from the connector or conduit under the area of installation as required by NEC84 Article 250-118, set screw 18 provides a second means of ensuring effective and serviceable ground connection to the connector or conduit.

Figure 6A:
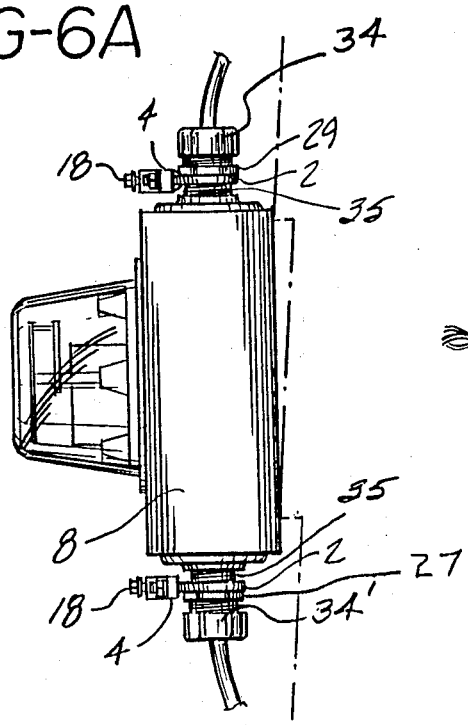
FIGS. 6A–C are diagrammatic views of the electrical conduit entrance box where the invention is to be attached.
Figure 6B:
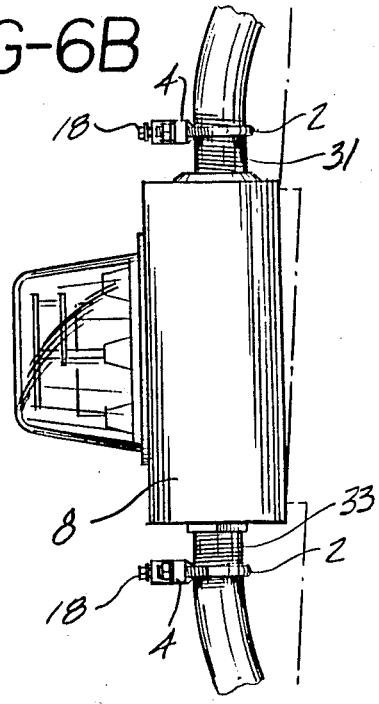
Figure 6C:
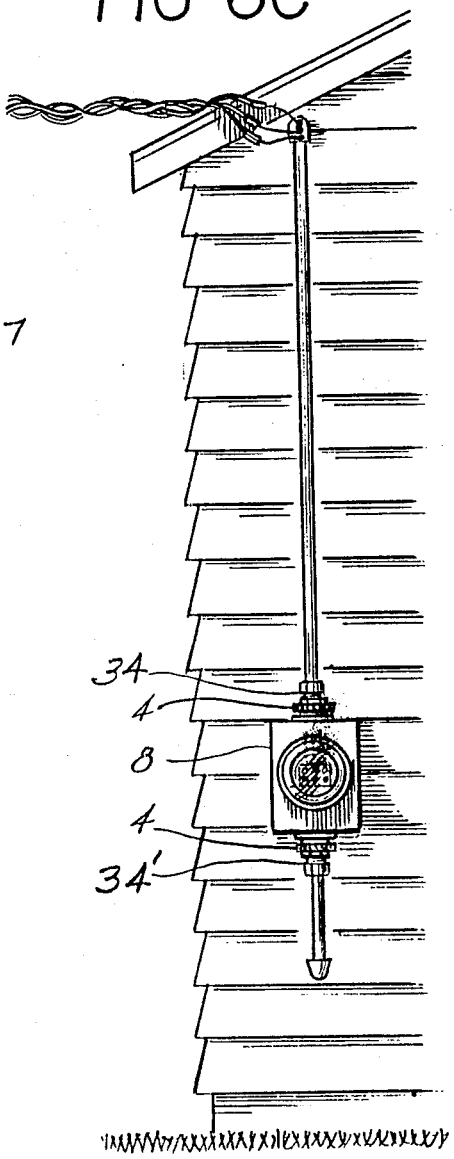
Figure 7:
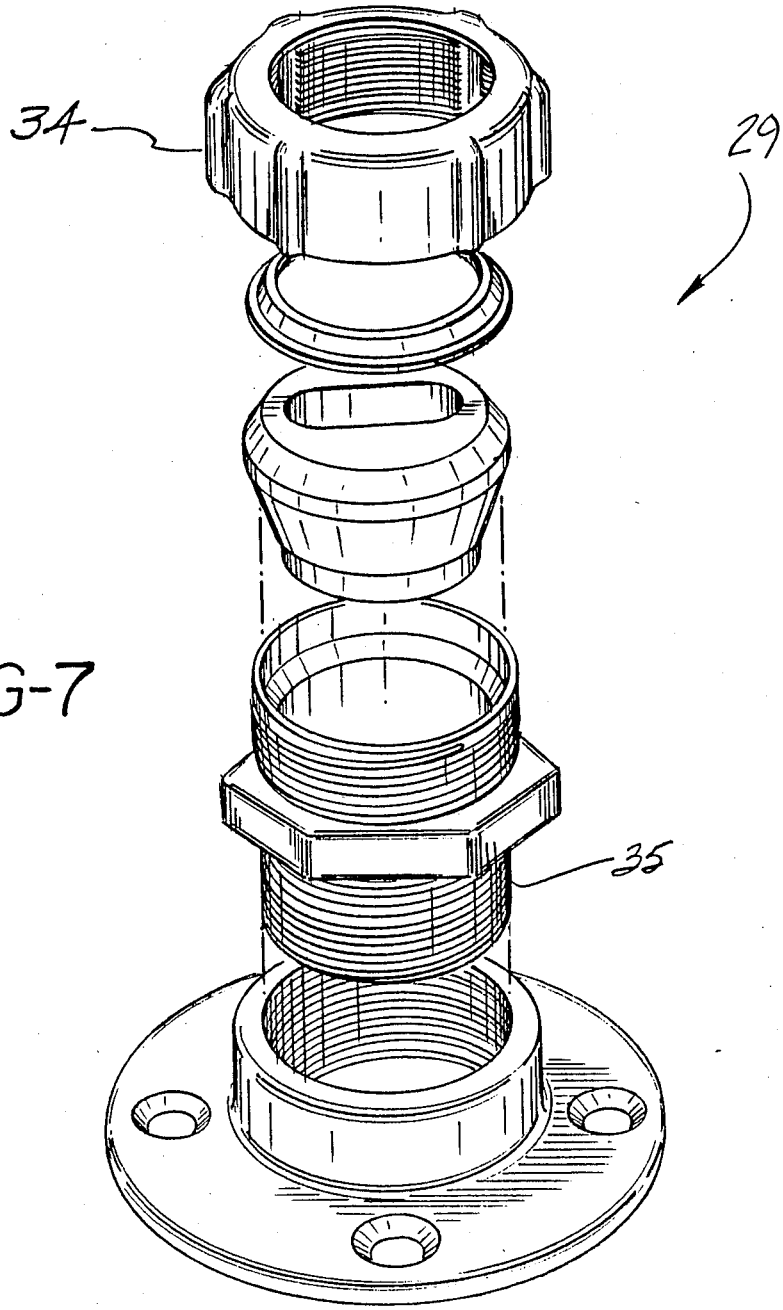
FIG. 7 is an exploded view of an electrical service cable entrance connector.

FIG. 6A–C shows the electrical service connections where the contactor of the present invention is designed for use. More specifically, the electrical junction box 8 is shown having upper and lower entrance cables connected thereto. At the top of box 8, there is connected a conduit fitting 31 or cable connector 29 through which the electrical supply power cable is inserted. Similarly, a cable connector 27 or conduit fitting 33 is provided at the bottom of box 8. The fittings 27 and 29 have adjusting mechanisms for their connection including water-tight bushing compression nuts 34 or 34'. As is now seen, the contactor of FIG. 1 is connected within the threaded areas 35 of the fittings 27 or 29 such that unimpeded access to the watertight bushing 34,34' is maintained. Fittings 27 and 29 have pipe thread on one end and machine thread on the other so that a sealing cap 34 can be screwed down to tighten a rubber bushing. Where such a fitting is mounted on the top of box 8, as is fitting 29, the invention is connected to the pipe thread portion. Where the fitting is mounted on the bottom of box 8, as is fitting 27, water seepage down the cable into the box 8 is no longer a problem so that the invention can be affixed to either the pipe thread or the machine thread.

Further, as can now be seen, set screw 18 is always accessible so that the user can adjust the set screw without removing the ground contactor. Thus, the electrical conductivity of the invention can be serviced and optimum electrical conductivity maintained by manipulating this set screw to enhance the conductivity between the yoke 4 and the surface upon which it is mounted. Because the invention is torqued to 150 inch pounds tightness, the set screw 18 has no mechanical function as it cannot pull yoke 4 out of contact. It serves solely as an electrical grounding function for the purpose of maintaining conductivity.

The screw 18 may be removed and the surface beneath the point of the screw cleaned by a burr inserted through the threaded hole 17. A new set screw can then be used in the invention with this clean surface.

While the specific embodiment of the invention is described and shown herein, it is to be understood that other embodiments may be resorted to without departing from the spirit and scope of my invention. What is desired to be covered by United States Letters Patent is set forth in the appended claims.

I claim:

1. An electrical contactor comprising:

U-shaped clamping means having first and second screw threaded end portions;

a yoke contactor having first and second apertures therein for interfitting with said clamping means via said screw threaded end portions;

the apertures in said yoke contactor having tapered inner surfaces therein for ensuring that forces applied are such that deformation of the clamping means can be obtained;

means coupled between said yoke contactor and said threaded portions of the clamping means for securing said yoke contactor to said clamping means;

contacting surface formed on said yoke contactor, said contacting surface being V-shaped and forming a knife-edge at the point of contact;

a threaded aperture formed in said contacting surface; and screw threaded means adjustable mounted in said threaded aperture for modifying the electrical conductivity between said yoke contactor and said contacting surface.

2. The electrical contactor of claim 1 wherein said yoke contactor includes tapered surfaces adjacent said means for securing said yoke contactor to said clamping means.

3. The electrical contactor of claim 1 wherein said threaded aperture is a threaded hole formed so as to provide passage of said screw threaded means without necessitating removal or other adjustment of said contactor in order to adjust said screw threaded means.

4. The contactor of claim 1 further including means coupled to said yoke contactor for connecting and securing electrical grounding conductors thereto.

* * * * *